US005931695A

United States Patent [19]

Scully et al.

[11] Patent Number: 5,931,695

[45] Date of Patent: Aug. 3, 1999

[54] RETAINING NUT

[75] Inventors: Michael Joseph Scully, Marysville; David Ray Radliff, Harrisburg, both of Pa.

[73] Assignee: The Whitaker Corporation, Wilmington, Del.

[21] Appl. No.: 08/992,143

[22] Filed: Dec. 17, 1997

[51] Int. Cl.[6] ..... H01R 13/73

[52] U.S. Cl. ..... 439/550

[58] Field of Search ..... 439/550, 565, 439/92; 411/525, 526, 527, 171, 409

[56] References Cited

U.S. PATENT DOCUMENTS

| | | | |
|---|---|---|---|
| 2,342,910 | 2/1944 | Tinnerman | 411/525 |
| 3,199,566 | 8/1965 | Dyka | 411/171 |
| 3,936,132 | 2/1976 | Hutter | 339/130 |
| 4,329,006 | 5/1982 | Gale | 339/126 |
| 4,421,369 | 12/1983 | Myking | 339/36 |
| 4,487,462 | 12/1984 | Gale et al. | 439/92 |
| 4,490,576 | 12/1984 | Bolante et al. | 411/525 |
| 4,721,481 | 1/1988 | Grellmann et al. | 439/581 |
| 4,726,788 | 2/1988 | F'Geppert | 439/551 |
| 5,713,692 | 2/1998 | McCarrick et al. | 411/526 |

*Primary Examiner*—Gary Paumen
*Assistant Examiner*—Antoine Ngandjui

[57] ABSTRACT

A retaining nut for securing an electrical connector to the surface of a an electrical panel or bulkhead. It has an annular ring having an upper surface, a lower surface and a central bore defining an inner periphery around an inside diameter of the ring. Several flexible, spring fingers are positioned around the inner periphery of the ring and project into the central bore. Preferably the fingers are helically arranged around the inside of the ring. Several upright posts positioned around and projecting outwardly perpendicularly from the upper surface of the ring aid manual insertion and removal of the nut. In use a cylindrical shaft having external threading around an outer circumference thereof positioned through the opening of a flat sheet panel. The a retaining nut is seated on the flat sheet and attaches to the shaft by means of the fingers engaging the external threading.

20 Claims, 2 Drawing Sheets

RETAINING NUT

BACKGROUND OF THE INVENTION

1. Field of the Invention

The present invention relates to connectors, such as electrical connectors or more particularly to a retaining nut for securing an electrical connector to the surface of an electrical panel or bulkhead.

2. Description of the Prior Art

It is common in the art that electrical connectors, such as coaxial connectors must be mounted on a flat panel. For these applications, various techniques have been developed for attaching the connector to the panel surface. The most common technique is to insert the connector through an opening in the panel and then securing it in the opening by a lock washer and/or a nut. In this regard, see U.S. Pat. Nos. 4,329,006; 4,726,788; 4,721,481; 4,421,369 and 3,936,132. Another technique is to mount an insulating sleeve or bushing over the connector body prior to insertion into the opening and attaching the sleeve to the panel opening by means of flanges. The use of a bushing or sleeve on the connector is not desired since it increases the diameter required for the mounting hole. If standard size mounting holes have already been punched in the panel, this means that the panel will have to be repunched, or otherwise modified to increase the hole diameters. The increased diameter required for the holes also reduces the connector density which may be accommodated on a panel. The reduction in panel thickness and the amount of material between mounting openings combine to reduce the strength of the mounting panel.

The use of a common threaded retaining nut is disadvantageous for several reasons. Typically, a retaining nut is machined to complement the external threading of a connector. Therefore an array of retaining nut sizes is required for a variety of connector diameters. Retaining nuts are often difficult to attach and detach and require special tooling. Prior art retaining nuts are frequently needing in environments which vibrate and tend to undesirably loosen under such vibrations.

It would be desired to employ a single type of retaining nut to accommodate a variety of connectors sizes. The retaining nut of this invention accomplishes this by employing an arrangement of spring fingers which flex to adapt to a limited series of connector sizes. It would also be desired to provide a retaining nut which can be attached to and detached from connectors without needing special tooling. The retaining nut of this invention has a series of outwardly projecting posts which facilitate manual attachment and detachment to connectors.

It is also desirable to provide a retaining nut which resists loosening under vibration conditions. The present invention counters vibrational loosening by having a knurled surface which is positioned against a flat panel.

These and other advantages will be in part discussed and in part apparent upon a consideration of the detailed description of the preferred embodiment.

SUMMARY OF THE INVENTION

The invention provides a retaining nut which comprises an annular ring having an upper surface, a lower surface and a central bore defining an inner periphery around an inside diameter of the ring; a plurality of flexible, spring fingers positioned around the inner periphery of the ring and projecting into the central bore; and a plurality of upright posts positioned around and projecting outwardly perpendicularly from the upper surface of the ring.

The invention also provides a connector comprising a cylindrical shaft having external threading around an outer circumference thereof; a retaining nut which comprises an annular ring having an upper surface, a lower surface and a central bore defining an inner periphery around an inside diameter of the ring; a plurality of flexible, spring fingers positioned around the inner periphery of the ring and projecting into the central bore; and a plurality of upright posts positioned around and projecting outwardly perpendicularly from the upper surface of the ring; the retaining nut being attached to the shaft by means of the fingers engaging the external threading.

The invention further provides a panel comprising a flat sheet having an opening therethrough; a cylindrical shaft having external threading around an outer circumference thereof positioned through the opening; and a retaining nut which comprises an annular ring having an upper surface, a lower surface and a central bore defining an inner periphery around an inside diameter of the ring; a plurality of flexible, spring fingers positioned around the inner periphery of the ring and projecting into the central bore; and a plurality of upright posts positioned around and projecting outwardly perpendicularly from the upper surface of the ring; the retaining nut being seated on the flat sheet and being attached to the shaft by means of the fingers engaging the external threading.

DETAILED DESCRIPTION OF THE PREFERRED EMBODIMENT

Figure 2:
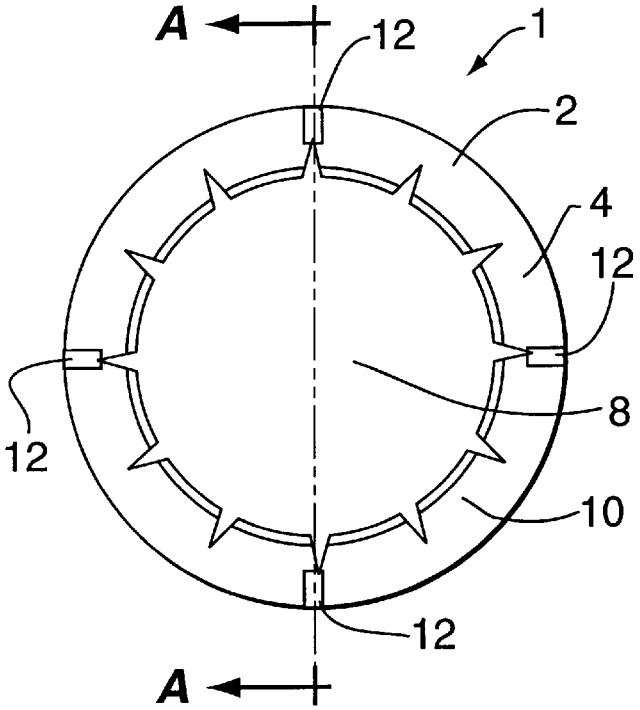
FIG. 2 is a top plan view of the retaining nut according to the invention.
Figure 3:
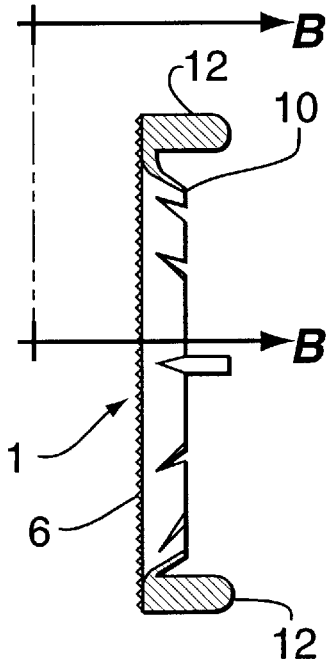
FIG. 3 is a side sectional view of the retaining nut according to the invention taken along lines A—A of FIG. 2.
Figure 1:
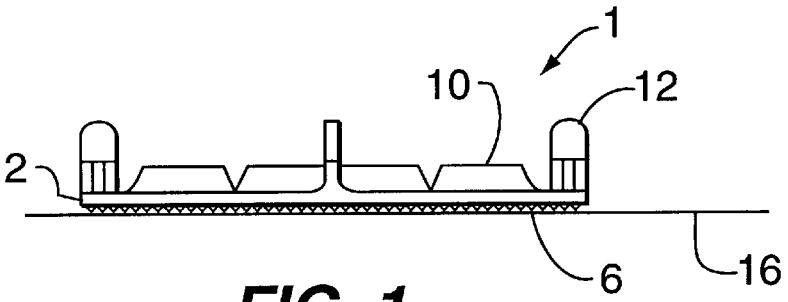
FIG. 1 is a side elevational view of the retaining nut according to the invention.

Referring to FIGS. 1 through 3, there is shown a retaining nut 1 which comprises an annular ring 2 having an upper surface 4, a lower surface 6 and a central bore 8 defining an inner periphery around an inside diameter of the ring. The nut 1 has a plurality of flexible, spring fingers 10 positioned around the inner periphery of the ring which project into the central bore 8. As used in the invention, the positioning of the fingers around the inner periphery of the ring includes fingers around the inside diameter surface of the ring, as well as fingers projecting inwardly from the upper surface of the ring. The nut also has a plurality of upright posts 12 positioned around and projecting outwardly perpendicularly from the upper surface 4 of ring 2.

In the preferred embodiment, the retaining nut is molded from an engineering plastic as is well known in the art. Engineering plastics non-exclusively include such materials as nylon and polycarbonate. In the preferred embodiment, the ring has a thickness which ranges from about 3 mm to about 7 mm, more preferably from about 3.5 to about 4.5 mm, although other thicknesses are also contemplated and may be easily determined by those skilled in the art depending on the intended use. In the preferred embodiment, the ring has an inside diameter which ranges from about 15 mm to about 100 mm, and an outside diameter of from about 25 to about 125 mm, although other inside and outside diameters are also contemplated and may be easily determined by those skilled in the art depending on the intended use.

Figure 5:
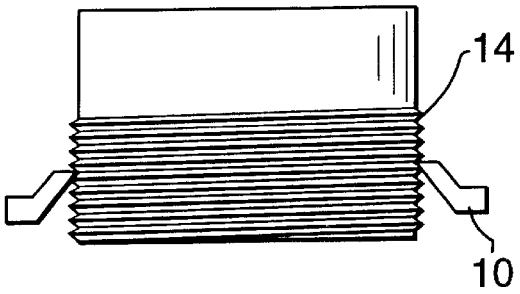
FIG. 5 is a view of the retaining nut according to the invention shown attached to a connector and positioned on a panel.
Figure 6:
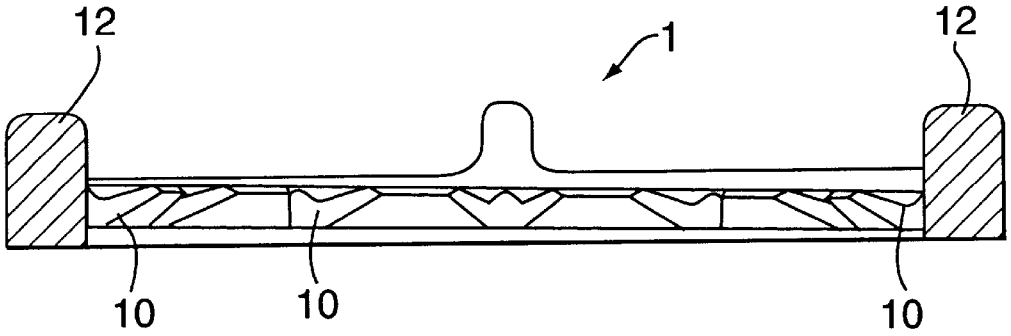
FIG. 6 is a side view of a retaining nut showing helically arranged fingers.
Figure 7:
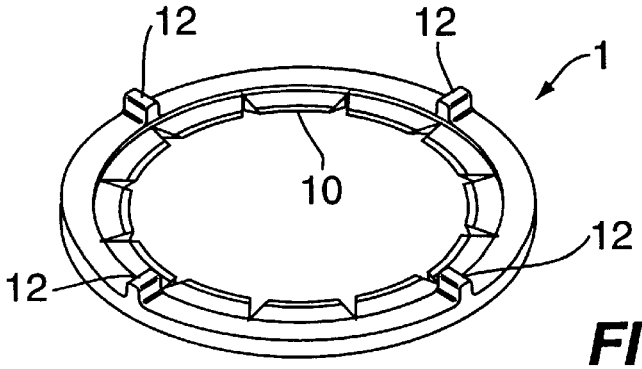
FIG. 7 is a side view of a retaining nut showing radially projecting fingers.

In one embodiment of the invention, the fingers 10 may project radially into the central bore from an inner edge of the ring as shown in FIG. 7. Alternatively, as seen in FIGS. 1 and 3, the fingers are slanted and project from the upper ring surface into the central bore 8. Slanted the fingers project into the bore 8 at an angle of more than zero degrees to about ninety degrees or less, relative to an imaginary axis through the center of the bore. In one particularly preferred embodiment as shown in FIG. 6, the fingers are arranged helically, i.e. threadlike at progressively different levels around the inner periphery. This aids screwing the retaining nut around a threaded connector. The spring fingers 10 serve to engage the outer threaded surface of a generally cylindrical shaft 14 as shown in FIG. 5. The shaft may be hollow as with a pipe or the like, or may be solid as with a bolt or the like. For the present invention, the term cylindrical shaft includes not only those which have a circular cross-section, but also non-circular cross-section such as D-shaped. Non-circular cross-section shafts provide an additional deterrence to shaft rotation. In addition, the spring fingers 10 extend a differential distance when engaging around the shaft and provide yet added rotational deterrence both to the shaft and the retaining nut.

The posts 12 serve to assist a manual force pressing or screwing of the retaining nut onto the shaft and to engage and disengage the shaft threads. There may be any convenient number of posts 12 which project around the upper surface of the retaining nut but preferably the posts are about equidistant around the circumference of the ring. There may be two, three, four or more posts as desired by those skilled in the art. It is also contemplated that there may be one continuous raised post around the circumference of the upper surface.

Figure 4:
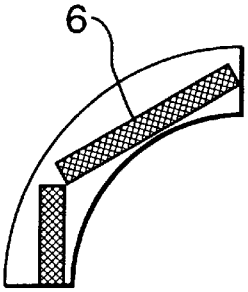
FIG. 4 is a bottom view of the retaining nut according to the invention taken along lines B—B of FIG. 3.

As shown in FIGS. 1, 3 and 4, the lower surface is preferably knurled, such as with a diamond shaped knurling. The knurling serves to minimize rotation of the nut when it is seated on a flat panel 16, and subjected to vibration in use. The knurling provides a reduced surface contact area to the bottom of the ring and also anchors into the surface of the flat panel when in position.

In use, a panel such as a flat, sheet metal electrical panel is provided with a circular or non-circular opening through its surface. A cylindrical shaft having external threading around an outer circumference is positioned through the opening and the retaining nut is manually pressed or screwed onto the shaft and engages the external threading. The nut is pressed or screwed on the shaft until it abuts against the flat sheet. The shaft may be disengaged from the flat panel by manually removing the nut via the posts by lifting or unscrewing as required.

What is claimed is:

1. A retaining nut which comprises an annular ring having an upper surface, a lower surface and a central bore defining an inner periphery around an inside diameter of the ring; a plurality of flexible, spring fingers positioned around the inner periphery of the ring and projecting into the central bore; and a plurality of upright posts positioned around and projecting outwardly perpendicularly from the upper surface of the ring.

2. The retaining nut of claim 1 wherein the fingers project radially into the central bore.

3. The retaining nut of claim 1 wherein the fingers project into the central bore at an angle of more than zero degrees and less than ninety degrees relative to an axis of the bore.

4. The retaining nut of claim 1 wherein the fingers are arranged helically around the inner periphery of the ring.

5. The retaining nut of claim 1 wherein the posts are about equidistant around the circumference of the ring.

6. The retaining nut of claim 1 comprising from about two posts to about four posts.

7. The retaining nut of claim 1 wherein the lower surface is knurled.

8. The retaining nut of claim 1 which comprises an engineering plastic material.

9. The retaining nut of claim 1 wherein the fingers are arranged helically around the inner periphery of the ring and project radially into the central bore; and comprising four posts about equidistant around the circumference of the ring and wherein the lower surface is knurled.

10. A connector comprising a cylindrical shaft having external threading around an outer circumference thereof; a retaining nut which comprises an annular ring having an upper surface, a lower surface and a central bore defining an inner periphery around an inside diameter of the ring; a plurality of flexible, spring fingers positioned around the inner periphery of the ring and projecting into the central bore; and a plurality of upright posts positioned around and projecting outwardly perpendicularly from the upper surface of the ring; the retaining nut being attached to the shaft by means of the fingers engaging the external threading.

11. The connector of claim 10 wherein the cylindrical shaft is hollow.

12. The connector of claim 10 wherein the cylindrical shaft is a bolt.

13. The connector of claim 10 wherein the lower surface is knurled.

14. The connector of claim 10 wherein the fingers wherein the fingers are arranged helically around the inner periphery of the ring and project radially into the central bore; and comprising four posts about equidistant around the circumference of the ring and wherein the lower surface is knurled.

15. A panel comprising a flat sheet having an opening therethrough; a cylindrical shaft having external threading around an outer circumference thereof positioned through the opening; and a retaining nut which comprises an annular ring having an upper surface, a lower surface and a central bore defining an inner periphery around an inside diameter of the ring; a plurality of flexible, spring fingers positioned around the inner periphery of the ring and projecting into the central bore; and a plurality of upright posts positioned around and projecting outwardly perpendicularly from the upper surface of the ring; the retaining nut being seated on the flat sheet and being attached to the shaft by means of the fingers engaging the external threading.

16. The panel of claim 15 wherein the cylindrical shaft is hollow.

17. The panel of claim 15 wherein the cylindrical shaft is a bolt.

18. The panel of claim 15 wherein the lower surface is knurled.

19. The panel of claim 15 wherein the fingers are arranged helically around the inner periphery of the ring and project radially into the central bore; and comprising four posts about equidistant around the circumference of the ring and wherein the lower surface is knurled.

20. The panel of claim 15 wherein the opening is non-circular.

* * * * *